US007383711B2

(12) United States Patent
McKenna

(10) Patent No.: US 7,383,711 B2
(45) Date of Patent: Jun. 10, 2008

(54) CNC LEVELER

(75) Inventor: James N. McKenna, Ellwood City, PA (US)

(73) Assignee: Blue IP, Inc., Callery, PA (US)

( * ) Notice: Subject to any disclaimer, the term of this patent is extended or adjusted under 35 U.S.C. 154(b) by 138 days.

(21) Appl. No.: 11/149,898

(22) Filed: Jun. 10, 2005

(65) Prior Publication Data

US 2006/0277959 A1 Dec. 14, 2006

(51) Int. Cl.
*B21D 1/02* (2006.01)

(52) U.S. Cl. ..... 72/164; 72/1; 72/13.4

(58) Field of Classification Search ..... 72/7.1, 72/13.4, 164, 165, 160, 1
See application file for complete search history.

(56) References Cited

U.S. PATENT DOCUMENTS

| | | | | |
|---|---|---|---|---|
| 4,084,424 | A * | 4/1978 | Roch et al. | 72/389.3 |
| 4,454,738 | A * | 6/1984 | Buta | 72/10.1 |
| 6,154,942 | A * | 12/2000 | Toeniskoetter | 29/243.58 |
| 6,792,783 | B1 | 9/2004 | Bergman et al. | |

FOREIGN PATENT DOCUMENTS

| | | |
|---|---|---|
| JP | 62-214825 | * 9/1987 |
| JP | 08-323418 | * 12/1996 |

OTHER PUBLICATIONS

Herr-Voss, "The Book On Leveling," booklet, 13th printing, Revised, Apr. 1999.
Herr-Voss Stamco, "Precision Leveler Plus," dual sided brochure, Nov. 2004, 2 pages.
Herr-Voss, "Corrective Sheet Metal Leveling Science, Art, or Black Magic?" brochure, Dec. 1997, 10 pages.
Herr-Voss Stamco, "Precision Roller Leveler in a Roll Forming Line," brochure, Dec. 2004, 10 pages.
Herr-Voss Stamco, "Precision Levelers—Strip Shape Control For Stamping and Roll Forming," brochure, 1990, 4 pages.
Herr-Voss, "Precision Levelers—Setting the Standard For Precision and Performance Worldwide," tri-fold brochure, 1990, 6 pages.
Herr-Voss Stamco, "Connection" newsletter, Sep. 2004, 1 page.
Jim McKenna, "CNC Precision Leveler Plus and Closed Loop Back-Up Control," powerpoint presentation, Genesis worldwide II Inc., Feb. 2005, 35 pages.
J. Neiland Pennington, "Leveler Automates Shape Correction," *Modern Metals*, Aug. 2004, pp. 28-30.

* cited by examiner

*Primary Examiner*—Daniel C Crane
(74) *Attorney, Agent, or Firm*—Kirkpatrick & Lockhart Preston Gates Ellis LLP

(57) ABSTRACT

Embodiments of a leveler that may be controlled by a computer are provided. The leveler may include a top frame that has at least a first set of rolls mounted thereon. The top frame includes a plurality of operatively associated ball screw assemblies that enable movement of the top frame with respect to a bottom frame of the leveler. The bottom frame has at least a second set of rolls mounted thereon. The leveler may further include at least one motor operatively associated with the plurality of ball screw assemblies. The motor is designed to drive the plurality of ball screw assemblies to move the top frame. The motor may also have at least one operatively associated encoder configured for monitoring or communicating data associated with rotation of the ball screw assemblies. The leveler may also include at least one position transmitter configured for monitoring a position of at least a portion of the top frame relative to a position of at least a portion of the bottom frame.

10 Claims, 21 Drawing Sheets

4-HIGH ROLLER LEVELER

5-HIGH ROLLER LEVELER

6-HIGH ROLLER LEVELER

SPECIFICATIONS SCREEN 2

CALLERY STEEL PROCESSING
CALLERY, PA

STEEL
YIELD STRESS (P.S.I.)

| | 35,000 | 40,000 | 45,000 | 50,000 | 55,000 |
|---|---|---|---|---|---|
| 72" | 0.135 | 0.122 | 0.115 | 0.109 | 0.104 |
| 60" | 0.135 | 0.134 | 0.126 | 0.120 | 0.114 |
| MINIMUM | 0.024 | 0.024 | 0.024 | 0.024 | 0.024 |

ALUMINUM
YIELD STRESS (P.S.I.)

| | 25,000 | 30,000 | 35,000 | 40,000 | 45,000 |
|---|---|---|---|---|---|
| 72" | 0.135 | 0.135 | 0.132 | 0.124 | 0.106 |
| 60" | 0.135 | 0.135 | 0.135 | 0.135 | 0.128 |
| MINIMUM | 0.032 | 0.029 | 0.027 | 0.025 | 0.024 |

NOTE: MAXIMUM THICKNESS DENOTES MAXIMUM LEVELER CAPACITY. MAXIMUM LINE THICKNESS IS 0.135" FIR STEEL AND 0.135" FOR ALUMINUM

| MAIN SCREEN | | SCREEN LIST | MORE SPEC'S | | |
|---|---|---|---|---|---|

*FIG. 13B*

STRETCH TRANSMITTER CALIBRATION

THIS PROCEDURE WILL CALIBRATE THE STRETCH TRANSMITTERS.

WOULD YOU LIKE TO PERFORM THE CALIBRATION NOW?

YES NO

*FIG. 15*

STRETCH TRANSMITTER CALIBRATION

CAUTION!!

INITIATING THIS PROCEDURE WILL CAUSE THE LEVELER TOP FRAME AND TILT ADJUST DRIVES TO RUN AUTOMATICALLY. MAKE SURE ALL PERSONNEL ARE AWAY FROM THE MACHINE AND THERE IS NO MATERIAL IN THE MACHINE.

PROCEED WITH FULLY AUTOMATIC STRETCH TRANSMITTER CALIBRATION?

GO

RETURN TO CALIBRATION MENU

*FIG. 16*

STRETCH TRANSMITTER CALIBRATION

CAUTION!!

INITIATING THIS PROCEDURE WILL CAUSE THE LEVELER TOP FRAME AND TILT ADJUST DRIVES TO RUN AUTOMATICALLY. MAKE SURE ALL PERSONNEL ARE AWAY FROM THE MACHINE AND THERE IS NO MATERIAL IN THE MACHINE.

PROCEED WITH FULLY AUTOMATIC STRETCH TRANSMITTER CALIBRATION?

ABORT

CALIBRATING STRETCH TRANSMITTERS

CALIBRATION IN PROGRESS

*FIG. 17*

STRETCH TRANSMITTER CALIBRATION

CAUTION!!

INITIATING THIS PROCEDURE WILL CAUSE THE LEVELER TOP FRAME AND TILT ADJUST DRIVES TO RUN AUTOMATICALLY. MAKE SURE ALL PERSONNEL ARE AWAY FROM THE MACHINE AND THERE IS NO MATERIAL IN THE MACHINE.

PROCEED WITH FULLY AUTOMATIC STRETCH TRANSMITTER CALIBRATION?

TOP FRAME CLOSING

ABORT

CALIBRATION IN PROGRESS

*FIG. 18*

STRETCH TRANSMITTER CALIBRATION

CAUTION!!

INITIATING THIS PROCEDURE WILL CAUSE THE LEVELER TOP FRAME AND TILT ADJUST DRIVES TO RUN AUTOMATICALLY. MAKE SURE ALL PERSONNEL ARE AWAY FROM THE MACHINE AND THERE IS NO MATERIAL IN THE MACHINE.

PROCEED WITH FULLY AUTOMATIC STRETCH TRANSMITTER CALIBRATION?

TOP FRAME OPENING

ABORT

CALIBRATION IN PROGRESS

*FIG.19*

STRETCH TRANSMITTER CALIBRATION

CAUTION!!

INITIATING THIS PROCEDURE WILL CAUSE THE LEVELER TOP FRAME AND TILT ADJUST DRIVES TO RUN AUTOMATICALLY. MAKE SURE ALL PERSONNEL ARE AWAY FROM THE MACHINE AND THERE IS NO MATERIAL IN THE MACHINE.

PROCEED WITH FULLY AUTOMATIC STRETCH TRANSMITTER CALIBRATION?

CALIBRATION COMPLETE

RETURN TO CALIBRATION MENU

*FIG.20*

BACK-UP TRANSMITTER CALIBRATION

THIS PROCEDURE WILL CALIBRATE THE BACK-UP TRANSMITTERS.

BEFORE THIS PROCEDURE CAN BE PERFORMED, THE FOLLOWING CONDITIONS MUST BE MET. (REFER TO MAINTENANCE MANUAL FOR INSTRUCTIONS IF NECESSARY)

1. ALL BACK-UP WEDGES MUST BE SET TO THE "MECHANICAL ZERO" POSITION.
2. ALL TRANSMITTERS MUST BE SET TO THE "CENTER OF TRAVEL" POSITION.
3. LIMIT SWITCHES MUST BE SET FOR 1.5" OF TRAVEL, IN EITHER DIRECTION, FROM THE "MECHANICAL ZERO" POSITION.

WOULD YOU LIKE TO PERFORM THE CALIBRATION NOW?

YES NO

*FIG.22*

FRAME CALIBRATION

ARE ALL SPACERS TIGHT?

YES NO

VIEW POSITION FEEDBACK

*FIG.26*

CNC LEVELER

BACKGROUND

There are many industries that utilize flat rolled products in their manufacturing processes. Some of the key industries include consumer goods manufacturers, automotive manufacturers, residential and commercial building product suppliers, and machine manufacturers. These industries depend on roller levelers to produce quality parts that can help them reduce production costs, reduce assembly time and eliminate costly secondary processing requirements. To meet customer expectations, businesses that offer material processing equipment must provide machines that can produce uniform and accurately dimensioned products on a consistent basis.

There are a variety of shape defects that may arise in flat rolled metal materials. Mill induced defects in metal materials can include, for example, wavy edges, center buckles, quarter buckles, crossbow, and coil set. Such shape defects may be caused by misaligned rolls or other substandard equipment or manufacturing processes that can be found in an array of processing lines. Regrettably, material related shape problems result in inefficient operations at downstream processing plants, and material variability or inconsistency can cause production delays, customer dissatisfaction, and many other problems and potential costs. Unfortunately, conventional leveler machines generally suffer from lack of precision in their performance to attempt to correct these material defects. Such conventional machines also typically rely too heavily or unreasonably on the know-how of operators to produce a quality product.

In view of the problems described above, more effective and efficient systems and processes are needed that can address the deficiencies of conventional procedures for processing metal materials.

SUMMARY

The present invention provides embodiments of a leveler that may be controlled by a computer. The leveler may include a top frame that has at least a first set of rolls mounted thereon. The top frame includes a plurality of operatively associated ball screw assemblies that enable movement of the top frame with respect to a bottom frame of the leveler. The bottom frame has at least a second set of rolls mounted thereon. The leveler may further include at least one motor operatively associated with the plurality of ball screw assemblies. The motor is designed to drive the plurality of ball screw assemblies to move the top frame. The motor may also have at least one operatively associated encoder configured for monitoring or communicating data associated with rotation of the ball screw assemblies. The leveler may also include at least one position transmitter configured for monitoring data associated with a position of at least a portion of the top frame relative to a position of at least a portion of the bottom frame.

Embodiments of the leveler may include an operatively associated control computer system that can be configured to perform a number of functions including collecting data from the top frame motor encoder; using data collected from the top frame motor encoder in association with moving the top frame to a zero point; comparing position data associated with the zero point to position data associated with the position transmitter; calculating a machine stretch value based on comparing the zero point position data to the position transmitter position data; and/or, automatically compensating for the calculated machine stretch value.

BRIEF DESCRIPTION OF THE FIGURES

The utility of the embodiments of the invention will be readily appreciated and understood from consideration of the following description of the embodiments of the invention when viewed in connection with the accompanying drawings.

FIGS. 7-12, 13A, 13B and 14-26 include samples of various screen displays that provide access to a control computer system configured in accordance with embodiments of the invention.

DESCRIPTION

In general, embodiments of levelers provided in accordance with the present invention are designed for corrective leveling of flat rolled strip, sheets, or plates of various materials including many different types of metals. The levelers are designed to remove shape defects in material such as crossbow, coil set, wavy edges, center buckle, and other like defects. Precision roller levelers, for example, are provided that can compensate for any fiber length differential created in the material by producer mills, so that the end product fiber length is substantially uniform from end-to-end, from side-to-side, and from top-to-bottom. Consequently, roller levelers have a positive impact on business operation by helping to improve overall final product quality, to improve operating efficiency, and to reduce raw material costs by satisfying purchasing requirements for incoming materials.

Typical materials that may be leveled include hot-or-cold-rolled steel, high-strength-low-alloy steel, alloy steel, galvanized or other coated metals, stainless steel, perforated or stamped parts, aluminum alloys, copper alloys, and exotic metals. Factors involved in the design of a leveler include work roll size, spacing, deflection, machine frame rigidity, and roll drive system. These factors affect the amount of bending that can be performed by a leveler and its capacity to affect the shape of processed material.

Figure 1:
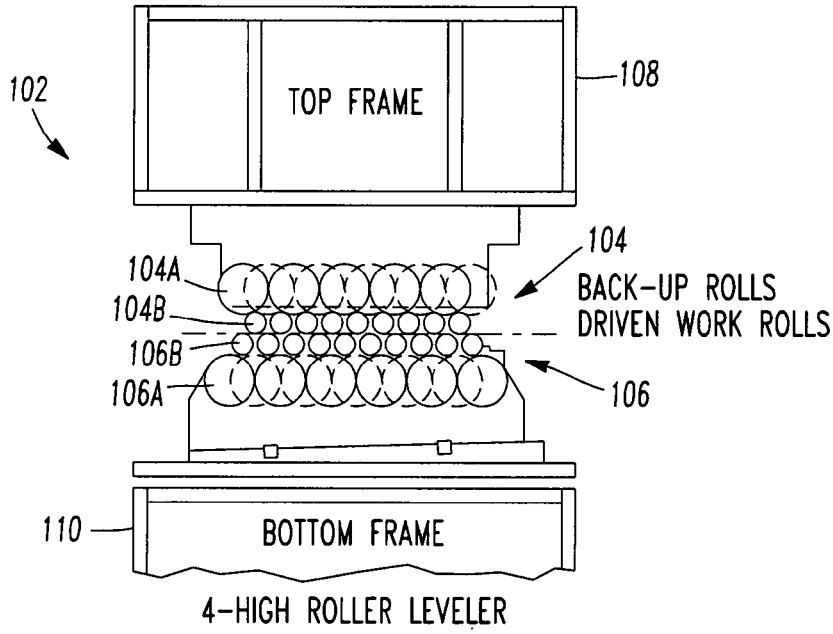
FIG. 1 includes a schematic of a portion of a leveler that may be used in accordance with the invention.
Figure 2:
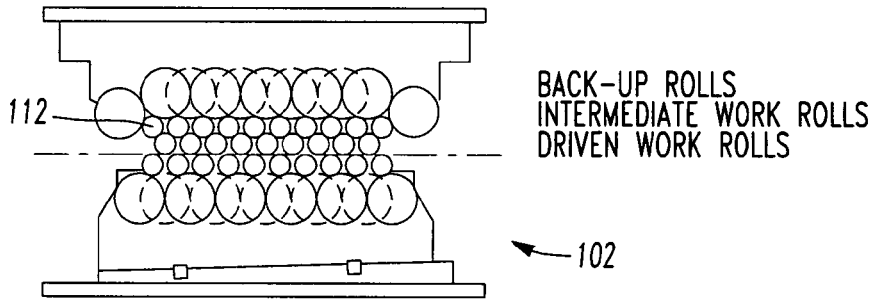
FIG. 2 includes a schematic of a portion of a leveler that may be used in accordance with the invention.
Figure 3:
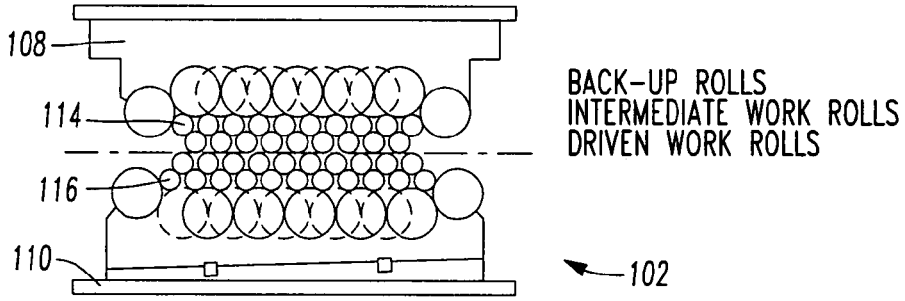
FIG. 3 includes a schematic of a portion of a leveler that may be used in accordance with the invention.

With reference to FIG. 1, aspects of a leveler 102 that may be employed in accordance with various embodiments of the present invention are shown for purposes of illustration. The four-high roller leveler 102 includes two sets of rolls 104, 106. The first set of rolls 104 includes a row of back-up rolls 104A and a row of driven work rolls 104B positioned adjacent to the row of back-up rolls 104A. The first set of rolls 104 may be operatively associated with or mounted on a top frame 108 of the leveler 102. The second set of rolls 106 likewise includes a row of back-up rolls 106A and a row of driven work rolls 106B positioned adjacent to the row of back-up rolls 106A. The second set of work rolls 106 may be operatively associated with or mounted on a bottom frame 110 of the leveler 102. During operation of the leveler 102, the work rolls 104B, 106B are supported by the back-up rolls 104A, 106A to control deflection caused by processing material through the leveler 102. FIG. 2 illustrates a five-high roll configuration of the leveler 102 in which a row of intermediate work rolls 112 may be generally interposed between the row of driven work rolls 104B and the row of back-up rolls 104A. Also, FIG. 3 illustrates a six-high roll configuration in which rows of intermediate work rolls 114, 116 may be interposed on the both the top frame 108 and the bottom frame 110 of the leveler 102. It can be appreciated that the rows of intermediate work rolls 112, 114, 116 may be structured and included in these configurations to reduce the chance that the work rolls 104B, 106B might otherwise mark relatively soft or highly polished strip surfaces.

In various leveler embodiments of the present invention, work rolls may be made from alloy steel and/or induction heat-treated for optimum combination of core toughness and controlled surface hardness and depth. For certain leveling applications, the work rolls may be structured to be exactly round and substantially the same diameter. In certain surface applications, the work rolls may be chrome plated, for example. End journals associated with the work rolls may be supported in sleeve bearings.

The back-up roll flights or assemblies may be included in the leveler embodiments to provide vertical and horizontal support for the work rolls. The back-up supports may be vertically adjustable and may include mating pairs of wedges. An inner wedge may be constrained to substantially vertical movement; and an outer wedge may be constrained to substantially horizontal movement by a machined slot in the frame upon which it rests for its full length. Horizontal adjustment of the outer wedge results in precise vertical adjustment of the back-up roller flight. The back-up rolls may include anti-friction bearings with a ground crown and blended radii to reduce marking of the work rolls or intermediate rolls supported by the back-up rolls. A set of work rolls may include manually adjustable back-up rolls and/or may be configured with remote-controlled or motorized capabilities for making adjustments during operation of the leveler.

In various leveler embodiments, each work roll may be driven at substantially the same speed by the transmission gears through double universal joint spindles, for example. Each drive spindle may be spring loaded and self-adjusting in length to provide a variety of angular positions. This telescoping feature is also convenient when disconnecting the roll drive during installation of new or reground work rolls, for example. Also, a transmission gear case may be operatively associated with the leveler including double distribution gears to ensure long life and dependable service. Shafts, pinions, and gears employed in the transmission gear case may be made from hardened alloy steel, for example, to maximize performance. The gears may be structured as helical gears to provide strength, durability and smooth operation without imparting undue vibrations to the rolls of the leveler.

Figure 4:
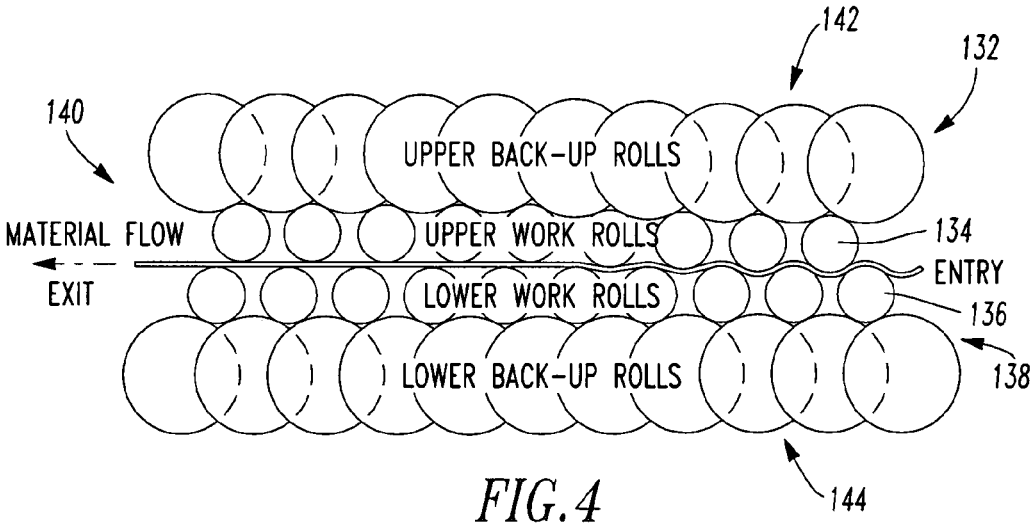
FIG. 4 includes a schematic of a roll configuration that may be used in accordance with embodiments of the invention.

An underlying principle in roller leveling is the selective elongation of portions of the strip or sheet so that tighter areas are proportionally stretched beyond the material's yield point to achieve essentially uniform strip "fiber" length. This is done by subjecting the strip to a series of up/down bends over small radii as it passes through the leveler in such a way that the shorter strip "fibers" travel longer path lengths. As the strip proceeds from the entry to the exit of the machine, the depth of these up/down bends are gradually reduced to eliminate the curvature caused by bending at the machine entry. When the lengths of all "fibers" are essentially the same, the strip is leveled. These bend reversals are achieved by passing the strip between upper and lower sets of parallel work rolls as shown in a longitudinal cross-section of a leveler 132 in FIG. 4, for example. The work rolls 134, 136 may be offset by half the roll spacing to force the strip to take a wavelike path through the machine as shown. The depths of the waves are generally configured to be greater at the entry 138 of the machine and tapering to a comparatively smaller degree at the exit 140. This is accomplished by adjusting the work rolls 134, 136 into a deeper nest at the entry 138 of the machine and a lighter nest at the exit 140. Variations in the length of the strip from top to bottom (giving coil set or crossbow, for example) can be reduced or eliminated by adjusting the work rolls 134, 136 for greater or lesser nest from entry 138 to exit 140.

Figure 5:
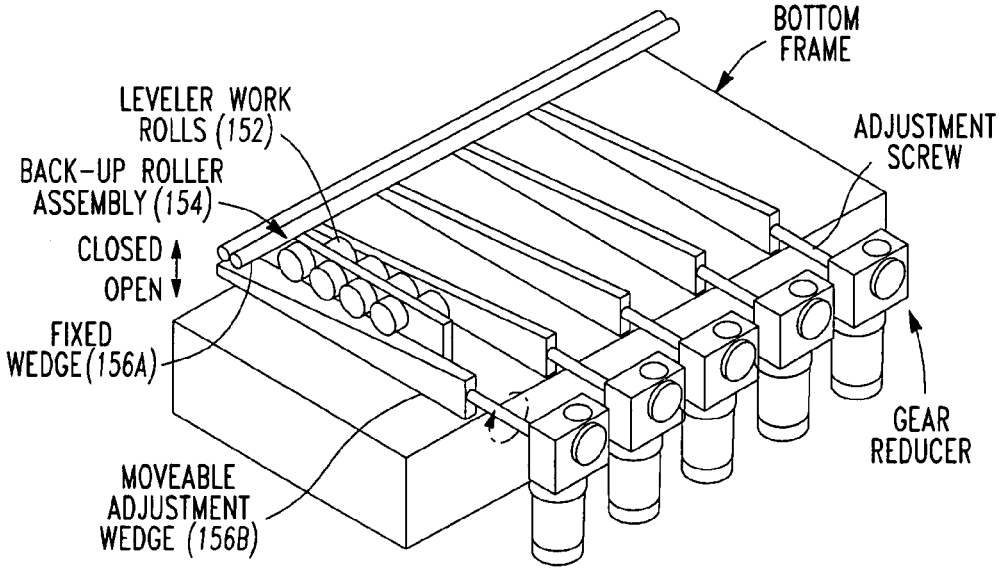
FIG. 5 includes a schematic of a portion of a leveler that may be provided in accordance with the invention.

As shown in FIG. 5, in certain leveler embodiments, the work rolls 152 may be supported by the back-up rolls 154 arranged in flights or assemblies. Each flight of back-up rolls 154 extends from entry to exit of the leveler, supporting a portion of each of the work rolls 152. Each lower back-up roll flight 154 can be adjusted up and down through wedge mechanisms 156A, 156B to control the upper/lower work roll nest at different points across the width of the leveler. To level a strip of material or to induce edge wave or center buckle, for example, multiple flights of backup rolls 154 supporting the work rolls 152 can be adjusted according to a desired result for the shape of the strip. To change strip shape characteristics, individual backup roll flights 154 can be independently adjusted to increase or decrease the work roll nest within localized sections of the leveler.

It can be seen that it is important to locate the working surfaces of a lower bank of work rolls of a leveler relative to its upper bank of work rolls. A precision leveler must be able to maintain the relative spacings between work rolls while under tremendous loads. The separating load caused by the bending forces working on the strip are transmitted directly to the back-up rolls and then to the leveler frames. It is physically necessary to stretch material beyond its yield point before changes or improvement in flatness can be achieved to level the material. As described above, leveling material is accomplished by positioning the upper and lower banks of work rolls in a nest that receives the material. Initial adjustments are made to the entry and exit height settings for the leveler. In general, the exit setting can be set to strip thickness, and the entry setting can be set for comparatively deeper penetration into the material. Starting with these initial adjustments, finer adjustments may be made by the leveler or an operator, for example, until desired flatness is achieved for the material as it emerges at the exit point of the leveler.

In various embodiments, each work roll of a leveler may be driven through a universal drive shaft, for example, in order to allow for adjustment of upper and lower roll assembly position during operation of the leveler. These shafts may be driven through a distribution type gear train employing helical gearing, for example, in a conventional oil bath lubrication system.

Figure 6A:
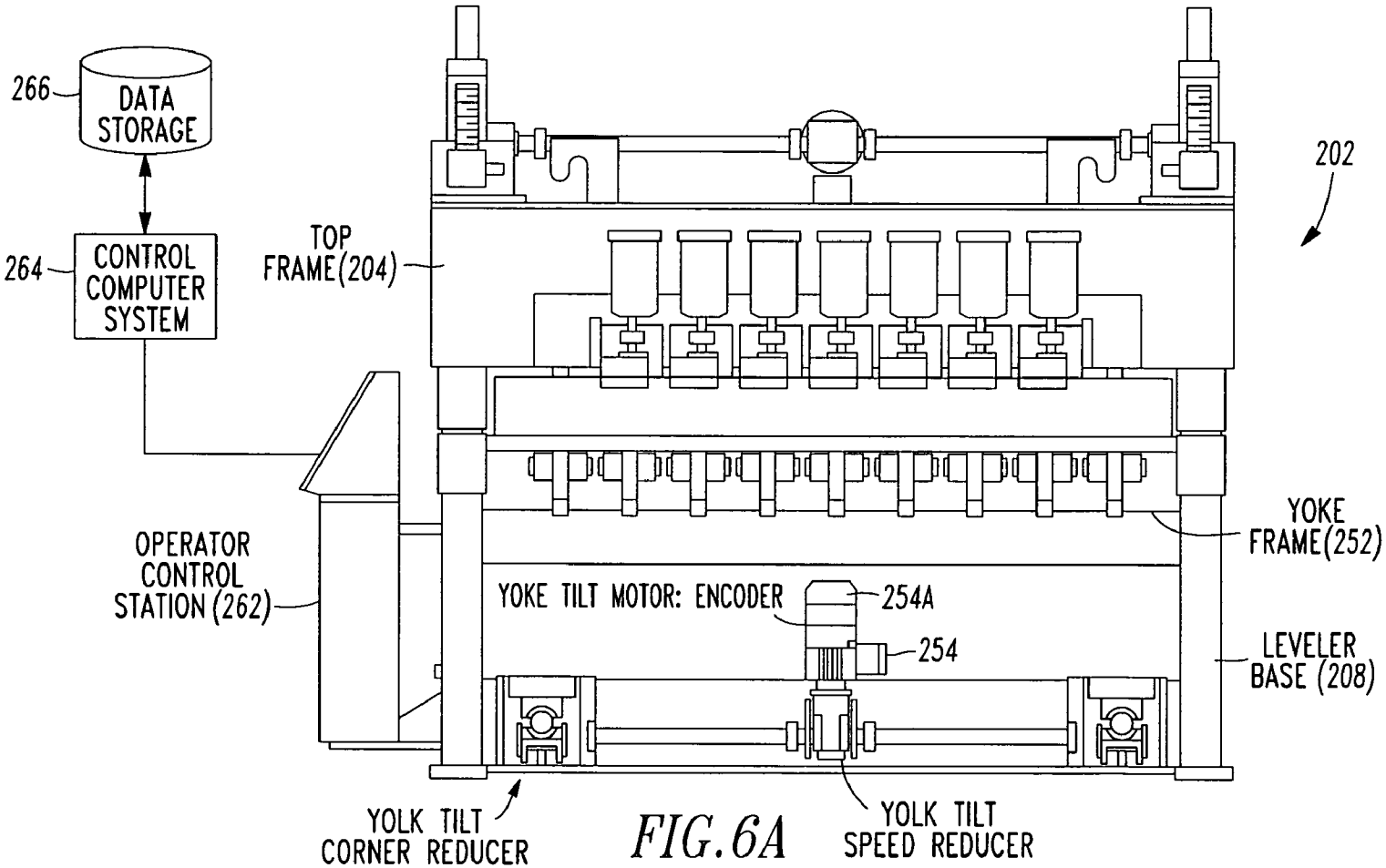
FIG. 6A is a front elevational view of a leveler structured in accordance with embodiments of the invention.
Figure 6B:
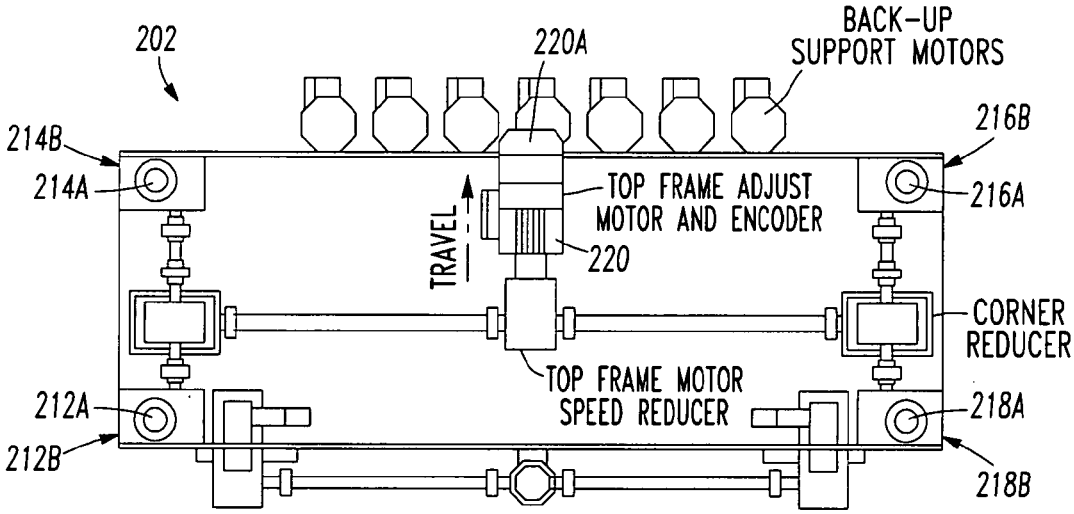
FIG. 6B is a top view of the leveler of FIG. 6A.
Figure 6C:
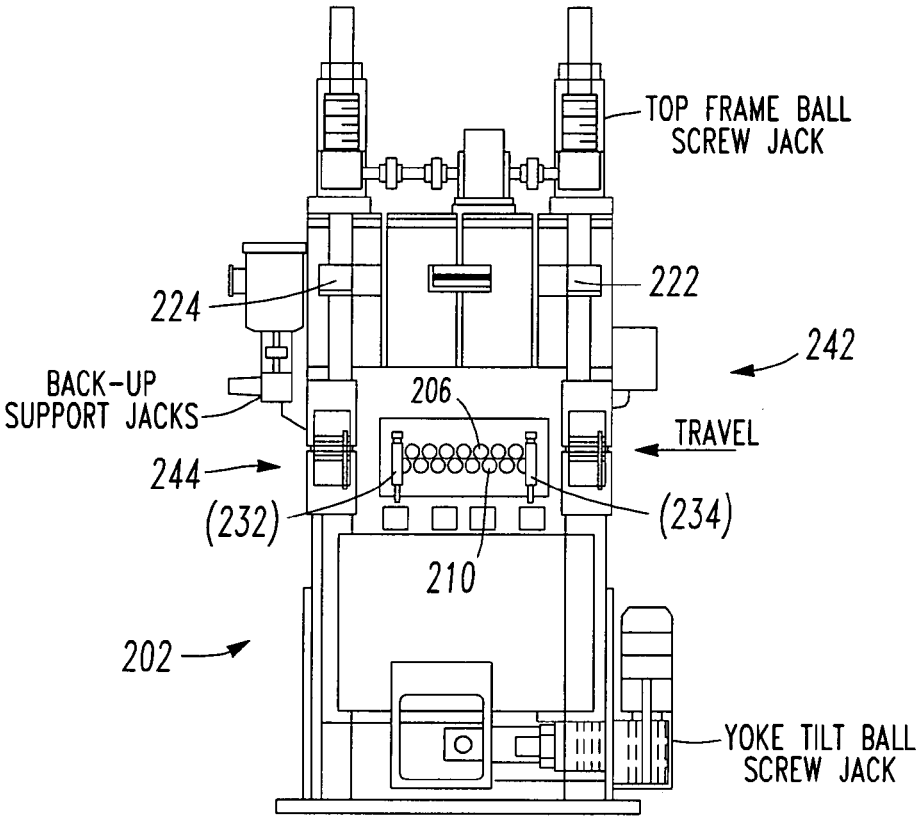
FIG. 6C is a side view of the leveler of FIG. 6A.

With reference now to FIGS. 6A through 6C, a leveler 202 structured in accordance with the present invention is illustrated. The leveler 202 includes a top frame 204 having at least a first set of rolls 206 mounted thereon, and a bottom frame 208 having at least a second set of rolls 210 mounted thereon. A plurality of ball screw assemblies 212A, 214A, 216A, 218A may be positioned in operative association with ball screw jacks 212B, 214B, 216B, 218B (respectively) of the leveler 202 to move the top frame 204 with respect to the bottom frame 208. In operation, the ball screw assemblies 212A, 214A, 216A, 218A permit the top frame 204 to move substantially vertically up or down with respect to the bottom frame 208. At least one motor 220 may be operatively associated with the plurality of ball screw assemblies 212A, 214A, 216A, 218A to drive the action of the ball screw assemblies 212A, 214A, 216A, 218A and permit movement of the top frame 204. The motor 220 may include at least one encoder 220A that can be configured for monitoring and communicating data associated with rotations of the ball screw assemblies 212A, 214A, 216A, 218A in their action to move the top frame 204. The motor 220 may be a variable speed AC motor, for example, or any other motor suitable generally for leveler applications in accordance with embodiments of the invention.

It can be appreciated that the use of the ball screw assemblies 212A, 214A, 216A, 218A in association with the present invention permits precise movement of the top frame 204 relative to the bottom frame 208. The structural characteristics of the ball screw assemblies 212A, 214A, 216A, 218A reduces the negative impact of frictional forces and backlash on movement of the top frame 204. In certain embodiments, to limit the effects of backlash forces on the ball screw assemblies 212A, 214A, 216A, 218A, one or more bushings 222, 224 may be installed within the corner posts of the leveler 202 to limit or restrict movement of the ball screw assemblies 212A, 214A, 216A, 218A to a substantially vertical up/down orientation. In addition, the top frame 204 may be keyed into the bottom frame 208 to reduce the chance of excessive load forces being experienced by the ball screw assemblies 212A, 214A, 216A, 218A. Any other conventional device for maintaining the ball screw assemblies 212A, 214A, 216A, 218A in a substantially vertical orientation and/or for reducing the effect of load forces on the ball screw assemblies 212A, 214A, 216A, 218A may also be employed within the scope of the invention.

Those skilled in the art will appreciate that a benefit of using the ball screw assemblies 212A, 214A, 216A, 218A is realized in the reduction of frictional forces that must be overcome and the reduction of electrical power that must be expended by the motor 220 to move the top frame 204 toward the bottom frame 208. Another benefit is provided in the form of enhanced precision of movement for the top frame 204 and the bottom frame 208, for example. For purposes of calibration, for example, the use of the ball screw assemblies 212A, 214A, 216A, 218A permits enhanced identification and positioning of a "zero point" for the top frame 204. The "zero point" may be considered that point at which movement of the top frame 204 results in correspondence of a predetermined reference point on a portion of the top frame 204 with a specified level of descent for the top frame 204 toward the bottom frame 208. In certain embodiments, the leveler 202 provides a calibration process that involves closing the top frame 204 down on a gauge bar, for example. By using reduced friction ball screw assemblies 212A, 214A, 216A, 218A, the top frame 204 can be moved at relatively low power or amperage of the motor 220. Identification of the calibration point for the top frame 204 can be determined at the point when an increase in motor 220 amperage occurs as the work rolls of the top frame 204 initially touch the gauge bar. In addition, the amount of rotations detected by the encoder 220A to achieve the zero point and/or other calibration points can be collected and stored for future reference in association with moving the top frame 204.

In various embodiments, one or more position transmitters 232, 234 may be installed on the leveler 202 to monitor or collect position data associated with a distance between a portion of the top frame 204 relative to a portion of the bottom frame 208. In certain embodiments, the position transmitters 232, 234 may include linear transducers installed and configured for collecting and communicating data associated with a distance between the relative positions of the frames 204, 208. The position transmitters 232, 234 may be installed to collect position data at one or both of an entry point 242 and an exit point 244 for material processed by the leveler 202.

In certain embodiments, the bottom frame 208 of the leveler 202 may include a yoke 252 structured to adjust degree of tilt for work rolls, among other rolls, mounted on the bottom frame 208. Such tilt adjustments may be made to adjust the position of rolls installed on the bottom frame 208 for a given roll intermesh application of the leveler 202, for example. The yoke 252 may include at least one motor 254 for driving the tilt action of the yoke 252. The motor 254 may be operatively associated with one or more ball screw assemblies that are actuated to effect movement of the yoke 252. In addition, the yoke motor 254 may include at least one encoder 254A that can be configured for monitoring and communicating data associated with rotations of the ball screw assemblies in their action to tilt the yoke 252. It can be appreciated that the yoke 252 permits the bottom frame 208 to rock in a saddle, with precision positioning supplied by a ball screw assembly arrangement operating in connection with the motor 254 and its encoder 254A capabilities.

A control station 262 may be operatively associated with the leveler 202 to receive data communicated from the encoders 220A, 254A or the position transmitters 232, 234, for example, and/or to perform other commands that manipulate the operation of the leveler 202. The control station 262 may include a control computer system 264 with one or more menu-driven user interfaces, for example, that permit an operator to provide commands that direct the action of the leveler 202 and/or to perform various calibration procedures for the leveler 202. The control computer system 264 may also be configured to receive and process data communicated by, for example, the encoders 220A, 254A the position transmitters 232, 234, the motors 220, 254, and/or other devices employed in association with the leveler 202. A database 266 or other suitable data storage medium or media may be operatively associated with the computer control system 264 to store data associated with the operation of the leveler 202.

In operation of the leveler 202, by tracking revolutions of the ball screw assemblies 212A, 214A, 216A, 218A with respect to their action to move the top frame 204, the encoder 220A enables movement of the top frame 204 to a repeatable zero point position. This zero point can be confirmed by one or more of the position transmitters 232, 234 to determine whether the top frame 204 and its associated work rolls are actually at the zero point or at some deviation from the zero point. Deviation of the top frame 204 from the zero point, as confirmed by the position transmitters 232, 234, may be caused by machine stretch affecting the leveler 202. Thus, the control computer system 264 can be configured to measure machine stretch by comparing data received from the encoder 220A to data received from one or both of the position transmitters 232, 234. This comparative data may be employed to calculate machine stretch, to calculate over-tilt between the entry point 242 and the exit point 244 of the leveler 202, and/or to make adjustments to the leveler 202 to account for the effect of machine stretch on the position of the work rolls, for example. With regard to safety and quality control considerations, the control computer system 264 may be configured to deactivate the leveler 202 when a threshold machine stretch value is met or exceeded.

With reference to FIGS. 7 through 26, the control station 262 may be configured with a variety of user interfaces that permit an operator to manipulate various functions of the leveler 202. The screen displays of FIGS. 7 through 26 are samples provided primarily for purposes of illustrating various aspects of the invention for those skilled in the art. In certain embodiments, the user interfaces may be activated or accessed through various touch screen controls. It can also be appreciated that certain screen display options described herein may be configured for limited access through specified system permissions or passwords.

Figure 7:
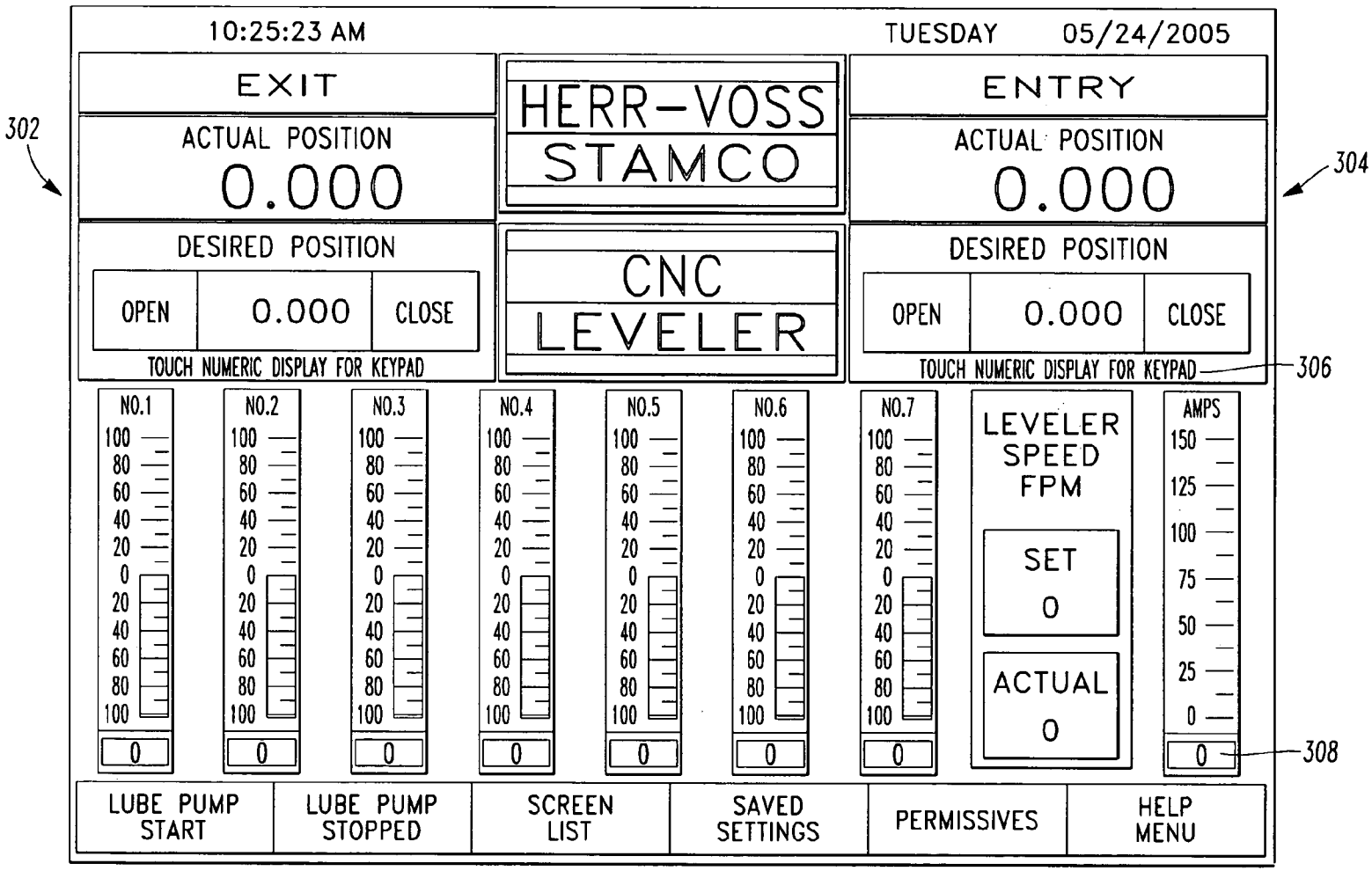

As shown in FIG. 7, a "main operator" screen display provides various functions for manipulation of a leveler provided in accordance with the present invention. An exit adjustment function 302 permits an operator to adjust exit settings for the position of work rolls at the exit point 244 of the leveler 202 and displays the current actual position of the work rolls at the exit point 244. Likewise, an entry adjustment function 304 permits an operator to adjust entry settings for the position of work rolls at the entry point 242 of the leveler and displays the current actual position of the work rolls at the entry point 242. A leveler speed function 306 permits the operator to adjust the rate at which material is fed through the leveler 202. Also, a leveler drive indicator 308 displays an amperage level for the main drive system of the leveler 202, including the motor 220.

Figure 8:
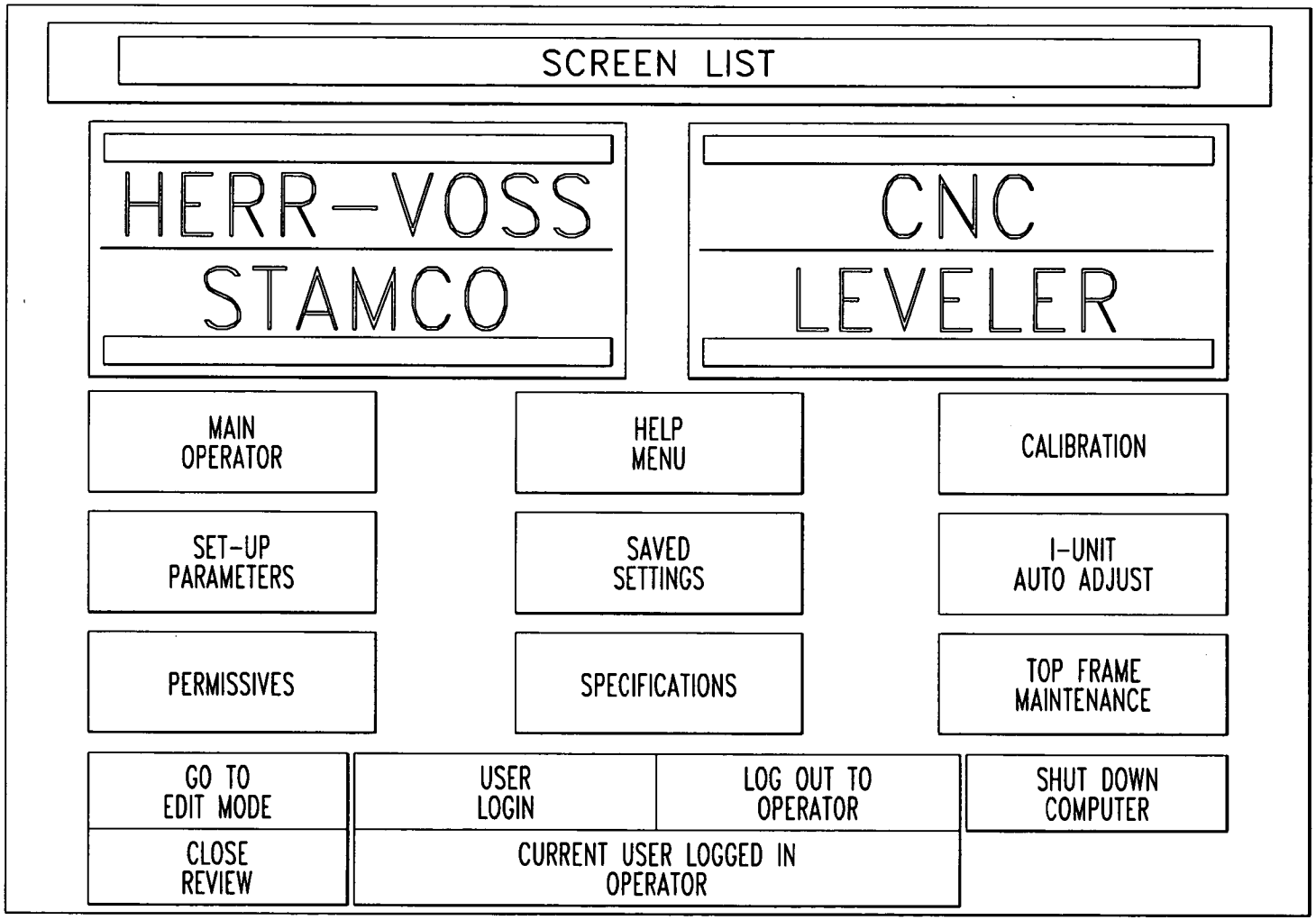

A "screen list" screen display, as shown in FIG. 8, provides various options that the operator may access including the main operator screen display (see FIG. 7), a "saved settings" screen display (see below), a "set-up parameters" screen display (see below), a "help menu" screen display (see below), and a "calibration" screen display (see below), among other options.

Figure 9:
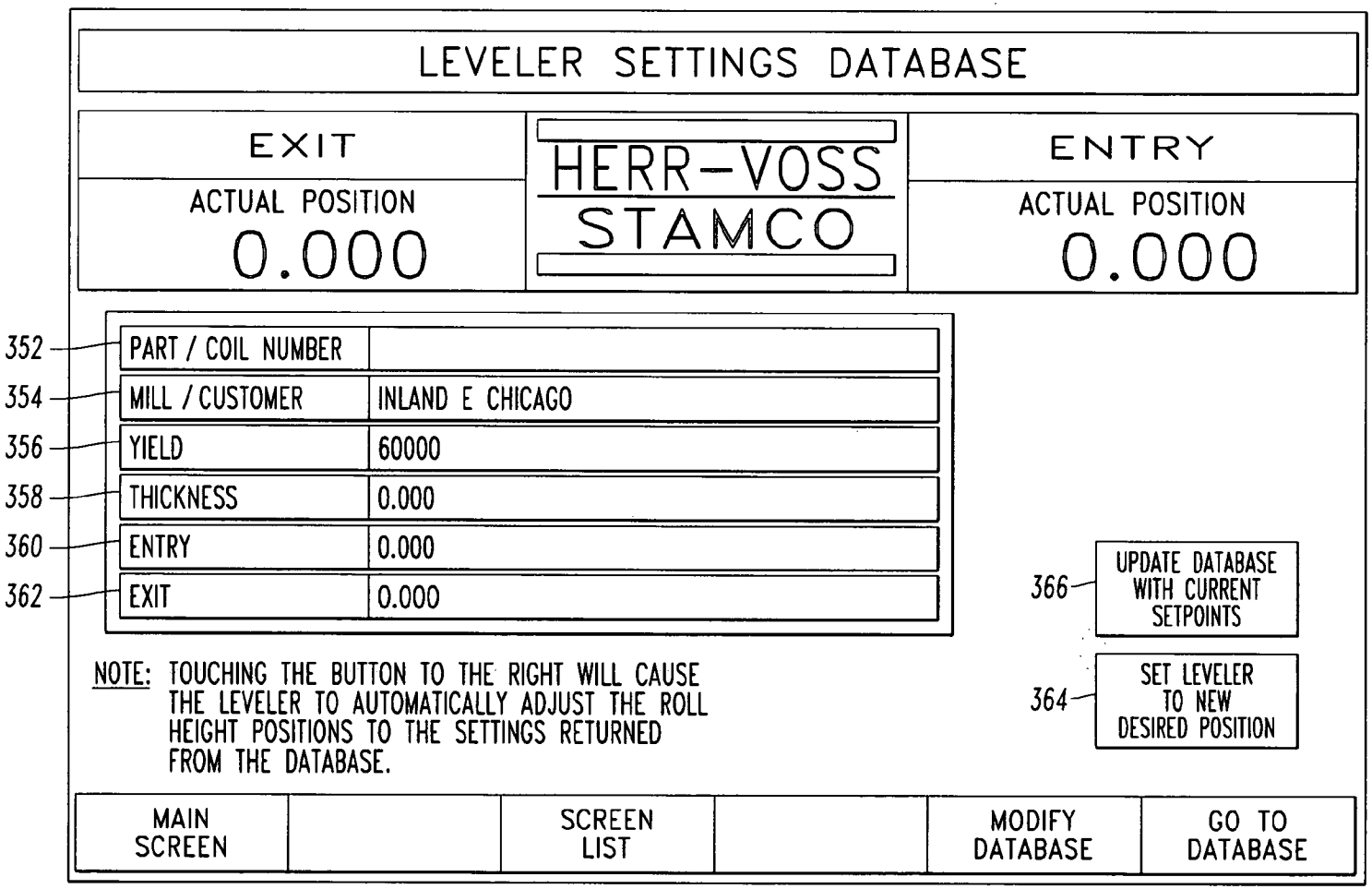

With reference to FIG. 9, the saved settings screen display can be used to access data from or store data to the database 266 of the control computer system 264. The data may be displayed on the basis of part or coil number 352 or by mill or customer identification information 354, for example. The operator can access leveler 202 settings for yield 356, thickness of material 358, entry position 360, or exit position 362. The operator may use data downloaded from the database 266 to set the leveler 202 by touching a button 364. The operator may also adjust leveler 202 settings and upload new settings data to the database 266 for future reference and material processing by touching the button 366.

Figure 10:
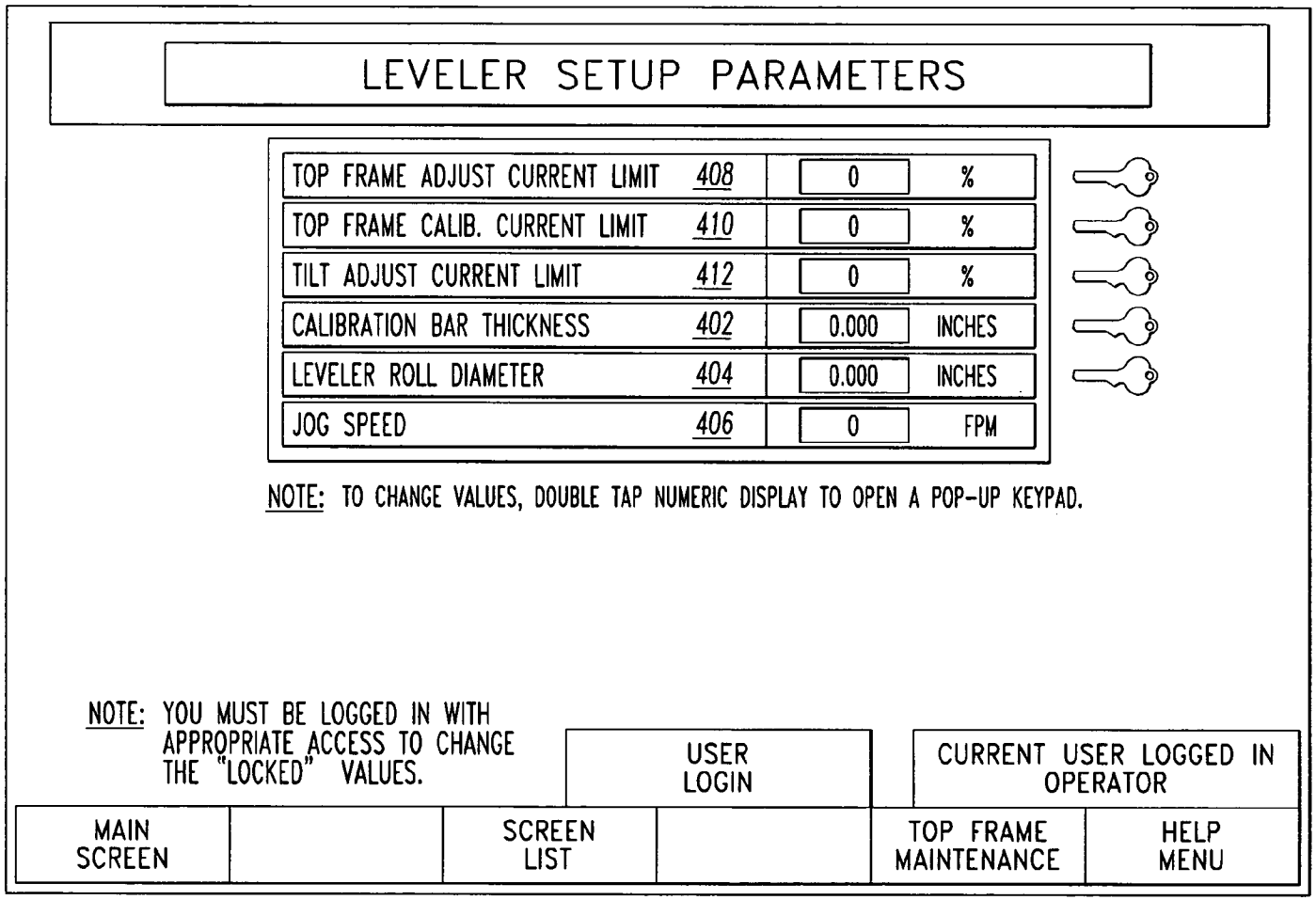

With reference to FIG. 10, the set-up parameters screen display can be employed to adjust various leveler 202 settings. The operator can set the calibration bar thickness 402, roll diameter 404, and the jog speed 406 for making adjustments to the rate at which material is fed through the leveler 202. In addition, current limits can be modified for top frame adjustment 408, top frame calibration 410, and/or tilt adjust 412 for the yoke 252 of the leveler 202. As shown, current limits are expressed as a percentage of the electrical power drawn by the leveler 202 drive devices in performing these various functions. For example, the operator may decide that the leveler 202 should not draw more than 60% of the total drive power when moving the top frame 204, and so the leveler 202 can be accordingly configured to shut down if it reaches the 60% threshold while moving the top frame 204. In accordance with discussion above, amperage level may also be used to calibrate certain aspects of the leveler 202 in calibration processes involving the use of gauge bars or spacers, for example. For example, the leveler 202 may be configured to automatically stop or shut down once a predetermined threshold amperage is met or exceeded in connection with the top frame 204 making initial contact with a gauge bar, calibration bar, or spacer.

Figure 11:
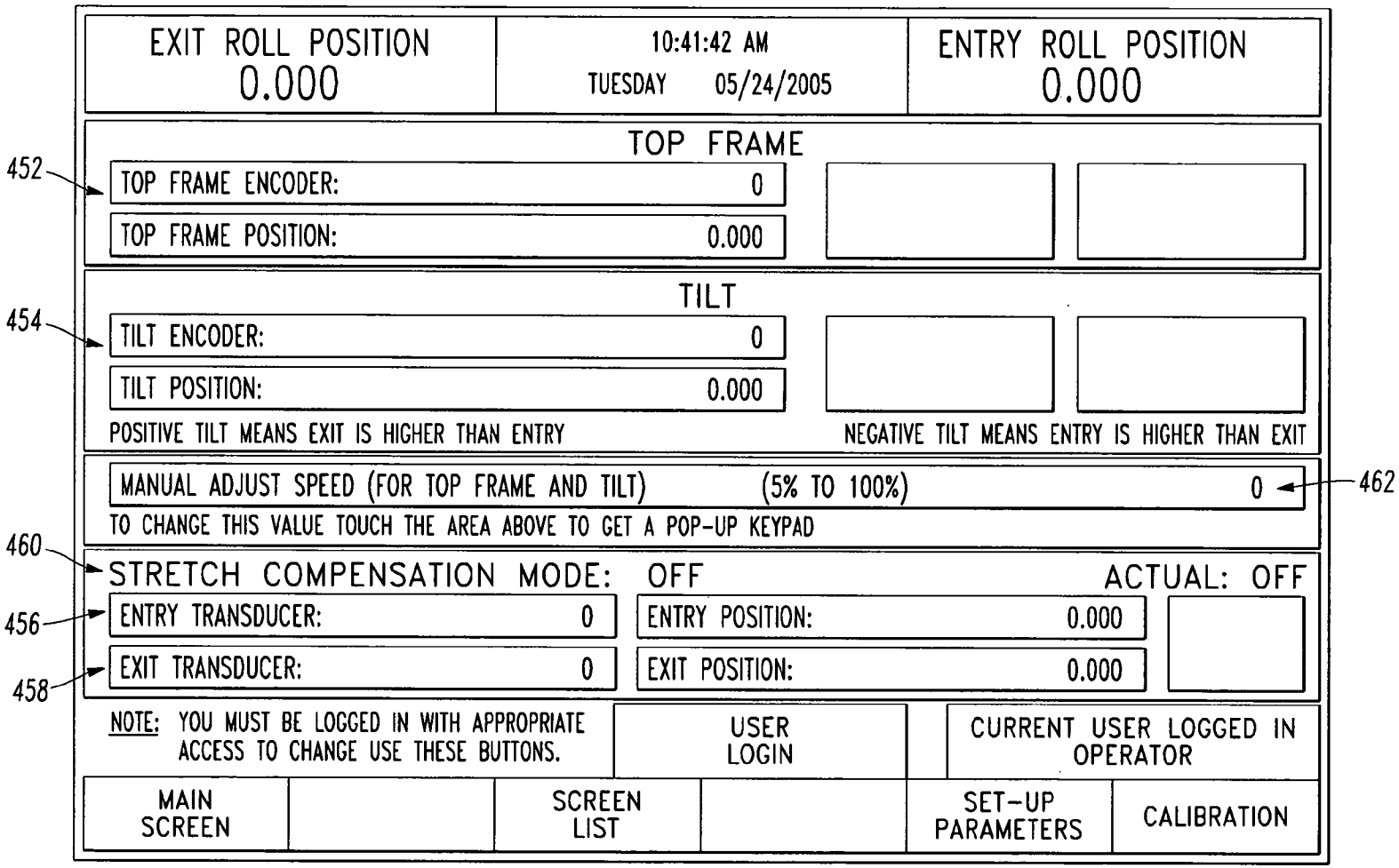

An "encoder position" screen display of FIG. 11 displays various data associated with the encoders 220A, 254A and position transmitters 232, 234 employed by the leveler 202. A top frame encoder section 452 provides readings for the current position of the top frame 204, and a tilt encoder section 454 provides readings for the current tilt position of the yoke 252. An entry transducer section 456 provides readings obtained from a position transmitter located at the entry point 242 of the leveler 202. Likewise, an exit transducer section 458 provides readings obtained from a position transmitter located at the exit point 244 of the leveler 202. A stretch compensation mode function 460 can be toggled on or off to command the leveler 202 to account (or not account) for the difference (i.e., machine stretch) in readings between the encoders 220A, 254A and the position transmitters 232, 234. When toggled on, the stretch compensation mode feature engages a feedback loop that adjusts the settings of the leveler 202 to achieve an actual position desired for processing material that accounts for calculated machine stretch. A manual adjust speed function 462 permits the operator to specify the speed for manual manipulation of movement of the top frame 204 and the tilt of the yoke 252.

Figure 12:
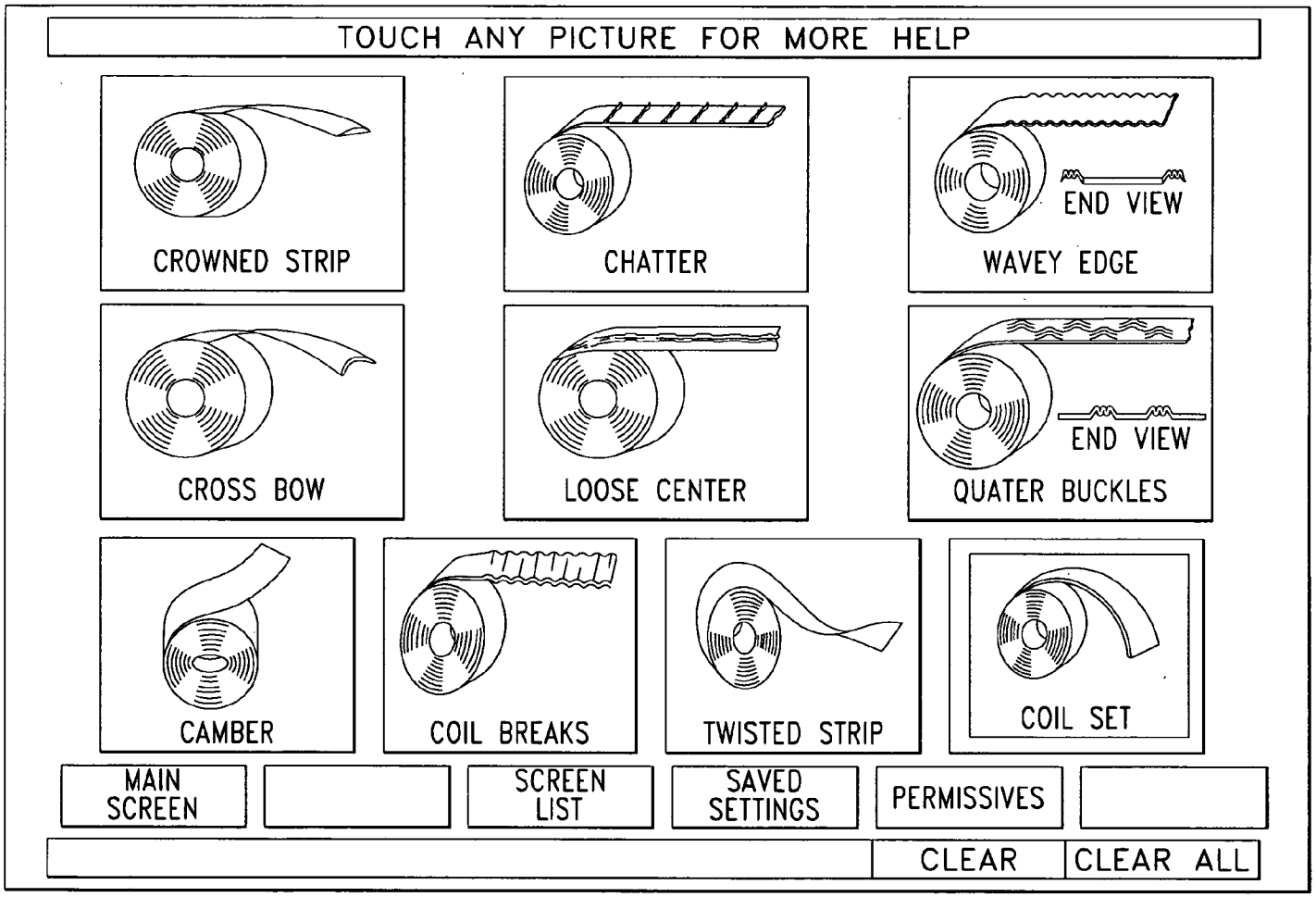
Figure 13A:
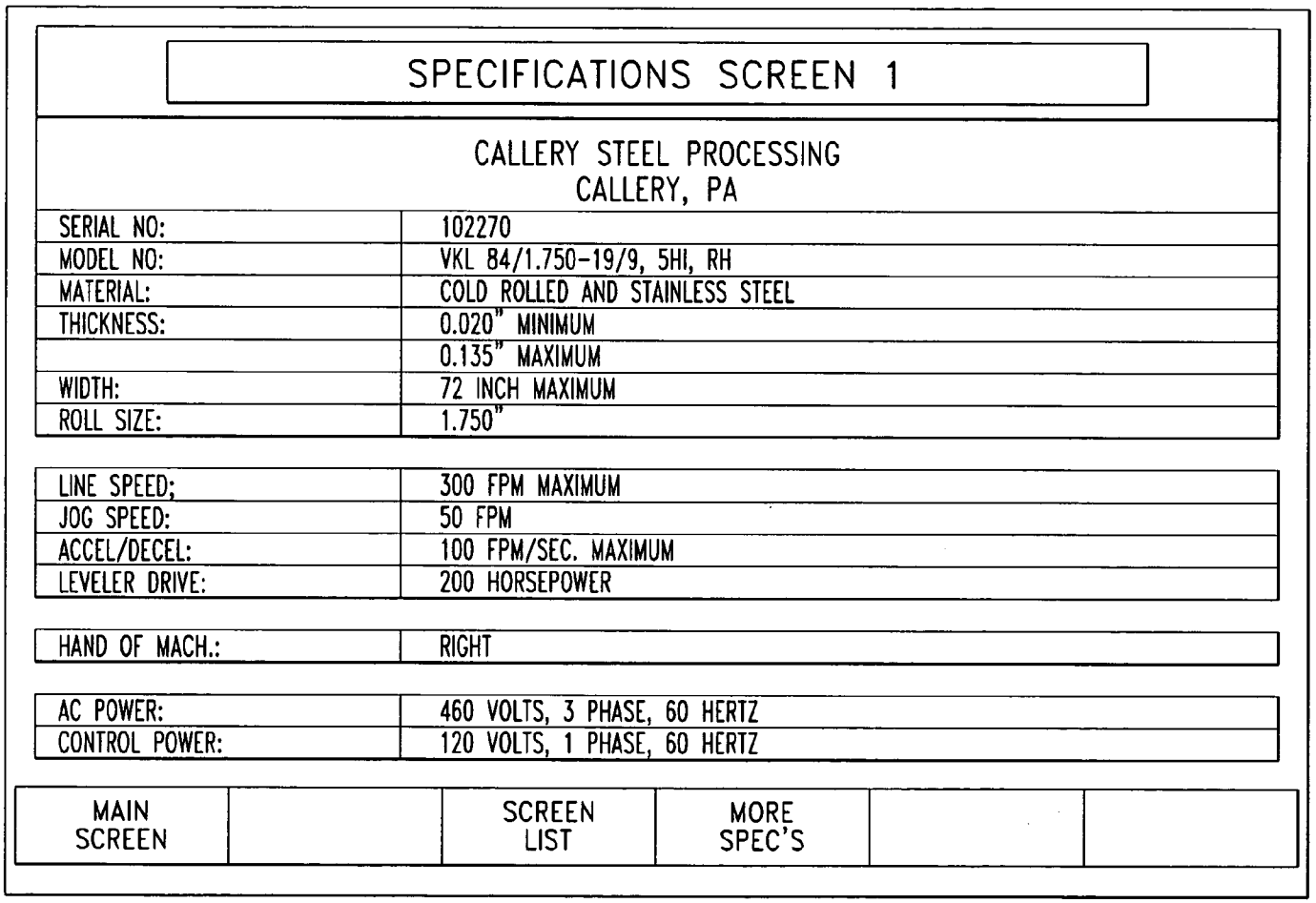

The help menu screen display of FIG. 12 provides detailed information that the operator can access to see details about a variety of conditions of material to be processed. FIGS. 13A and 13B include data related to various specifications for a given leveler.

Figure 14:
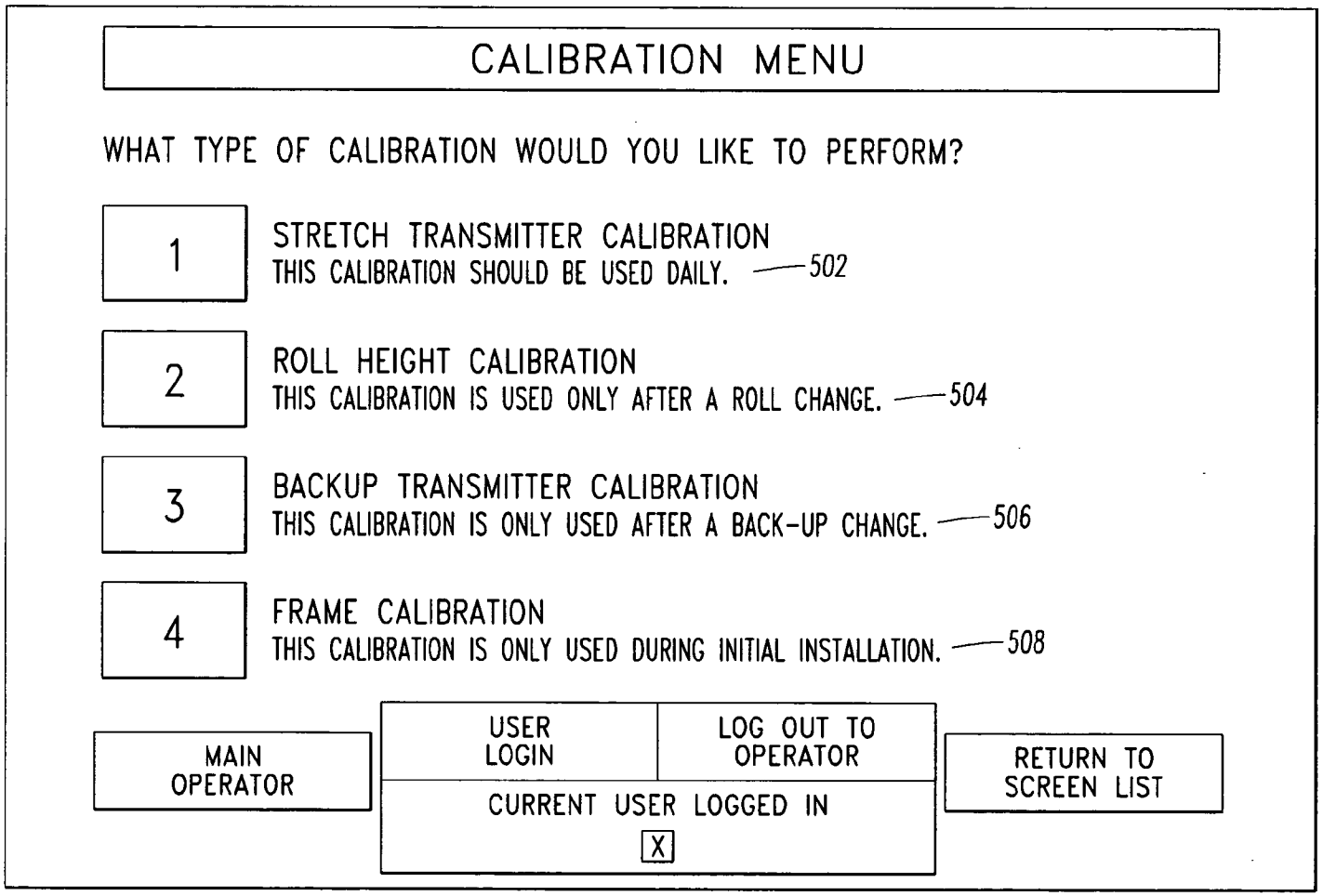

The calibration menu screen display of FIG. 14 includes options for the operator to select from among a variety of calibration functions that can be performed on the leveler 202 The calibration functions include a stretch transmitter calibration 502, a roll height calibration 504, a backup transmitter calibration 506, and a frame calibration 508.

If the operator selects the stretch transmitter calibration 502, the command is first confirmed as shown in FIG. 15, and then the operator may proceed with the calibration as shown in FIG. 16. The status screen display of FIG. 17 indicates that calibration is in progress, and the status screen display of FIG. 18 confirms that the top frame 204 of the leveler 202 is being moved to its zero point (as previously detected by the motor encoder 220A). This movement of the top frame 204 to the zero point is confirmed by the position transmitters 232, 234 during this calibration process. The status screen display of FIG. 19 then confirms that the top frame 204 is moving open relative to the bottom frame 208, and the status screen display of FIG. 20 confirms that the calibration is complete. If there is any deviation between the actual point to which the top frame 204 moves based on encoder 220A data and the reading provided by the position transmitters 232, 234, the zero point of the transmitters 232, 234, may be adjusted or calibrated in accordance with data collected by the encoder 220A.

Figure 21:
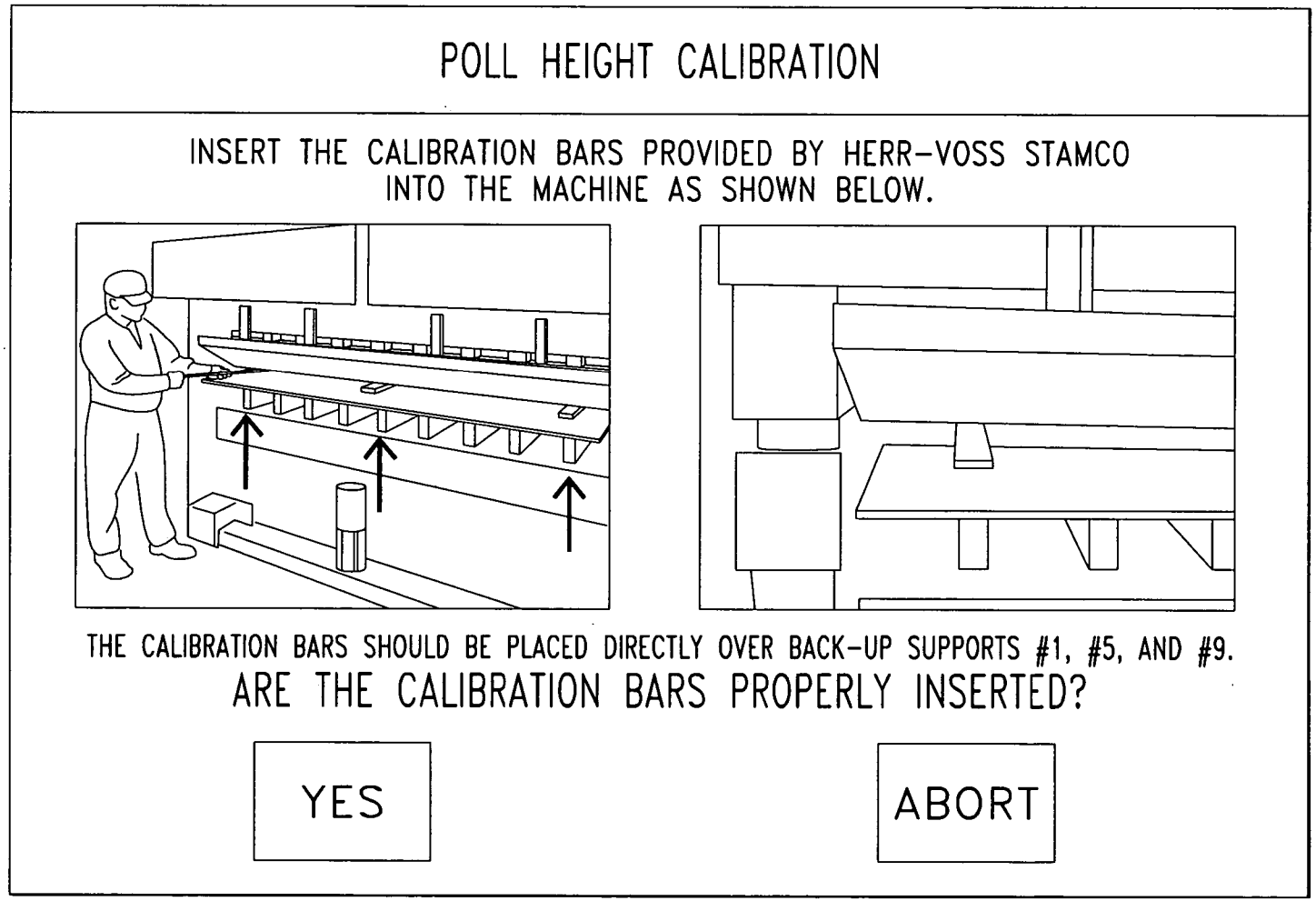
Figure 23:
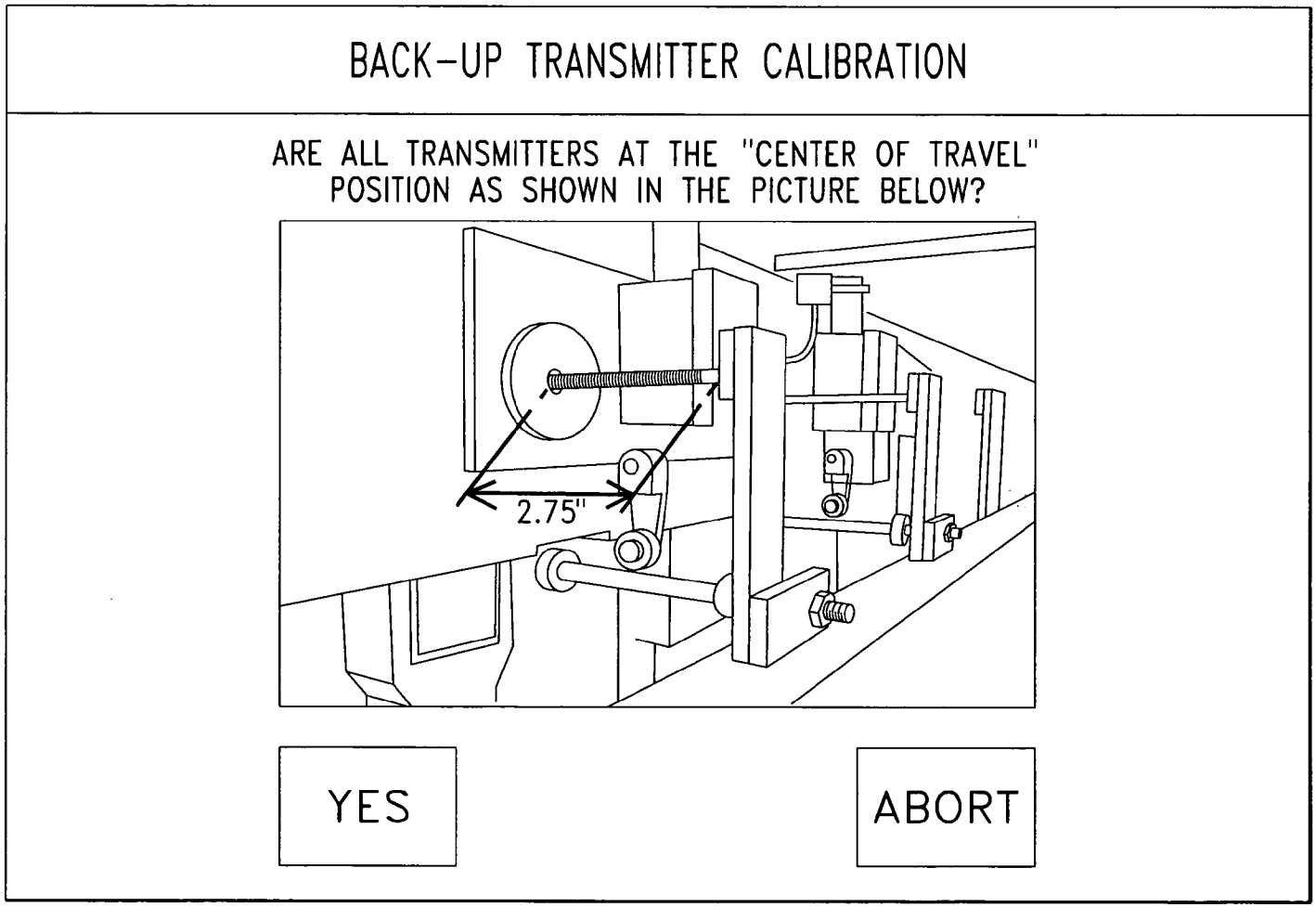
Figure 24:
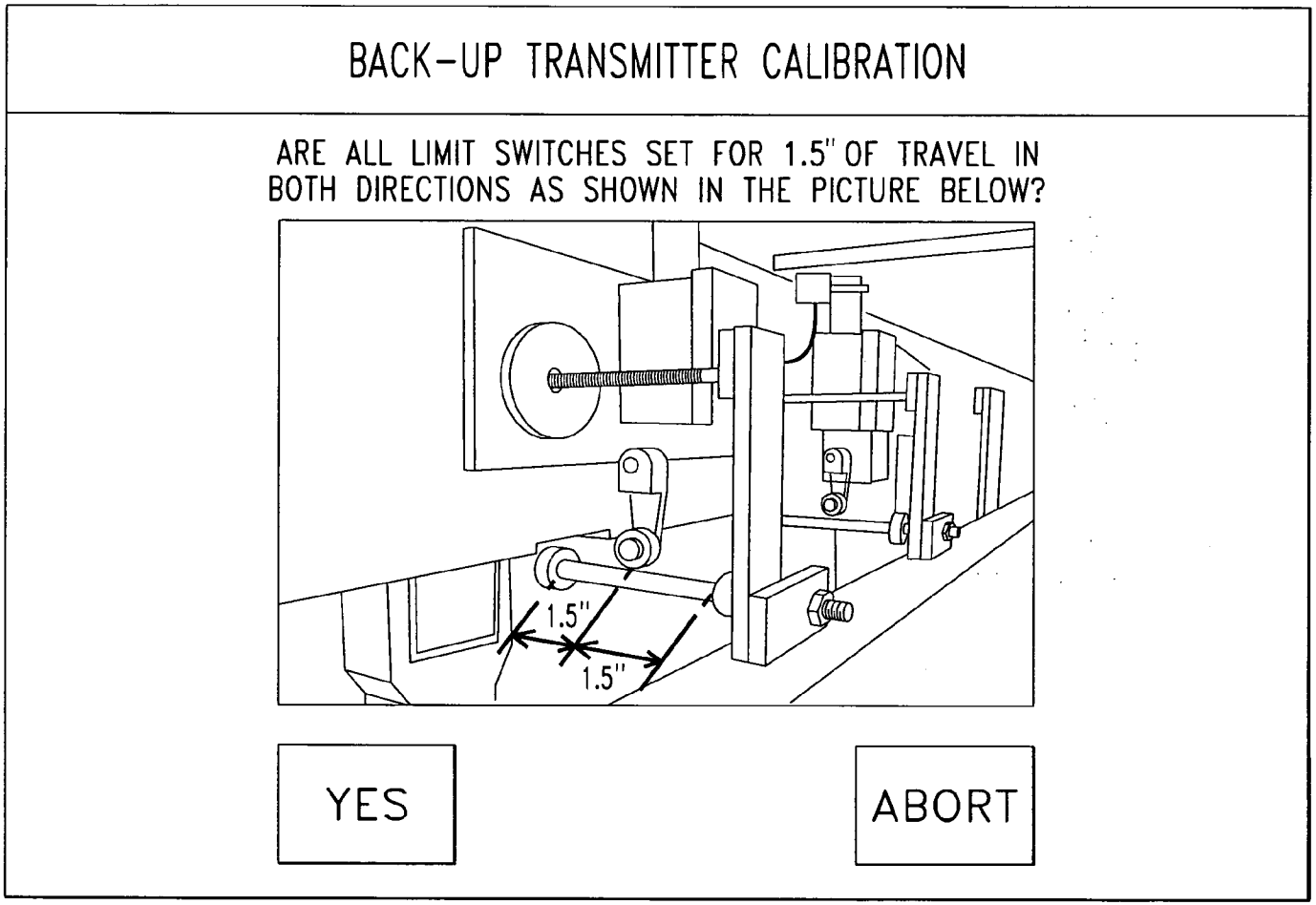

If the operator selects the roll height calibration 504 option, such as after a roll change has occurred, the operator is instructed to insert calibration bars into the leveler 202 as shown in FIG. 21. During this calibration process, the top frame 204 is moved down toward the bottom frame 208 to the point of initial contact with the calibration bars. This point of initial contact with the calibration bar may then be detected or determined once the top frame 204 has reached the preset calibration limit established for the calibration process (see, e.g., the limits illustrated in FIG. 10).

Encoder 220A data associated with this point of initial contact may then be communicated to the control computer system 264 to complete the calibration process. The operator may then remove the calibration bars from the leveler 202 once the calibration process is completed.

If the operator selects the back-up transmitter calibration 506 option, the instructional screen display of FIG. 22 is displayed to the operator. The operator is then presented with the instructional screen displays of FIGS. 23 and 24. This calibration procedure calibrates the permitted travel range for backup roll assemblies employed by the leveler 202. Once completed, the leveler 202 sets parameters for the positions of the backup roll assemblies.

Figure 25:
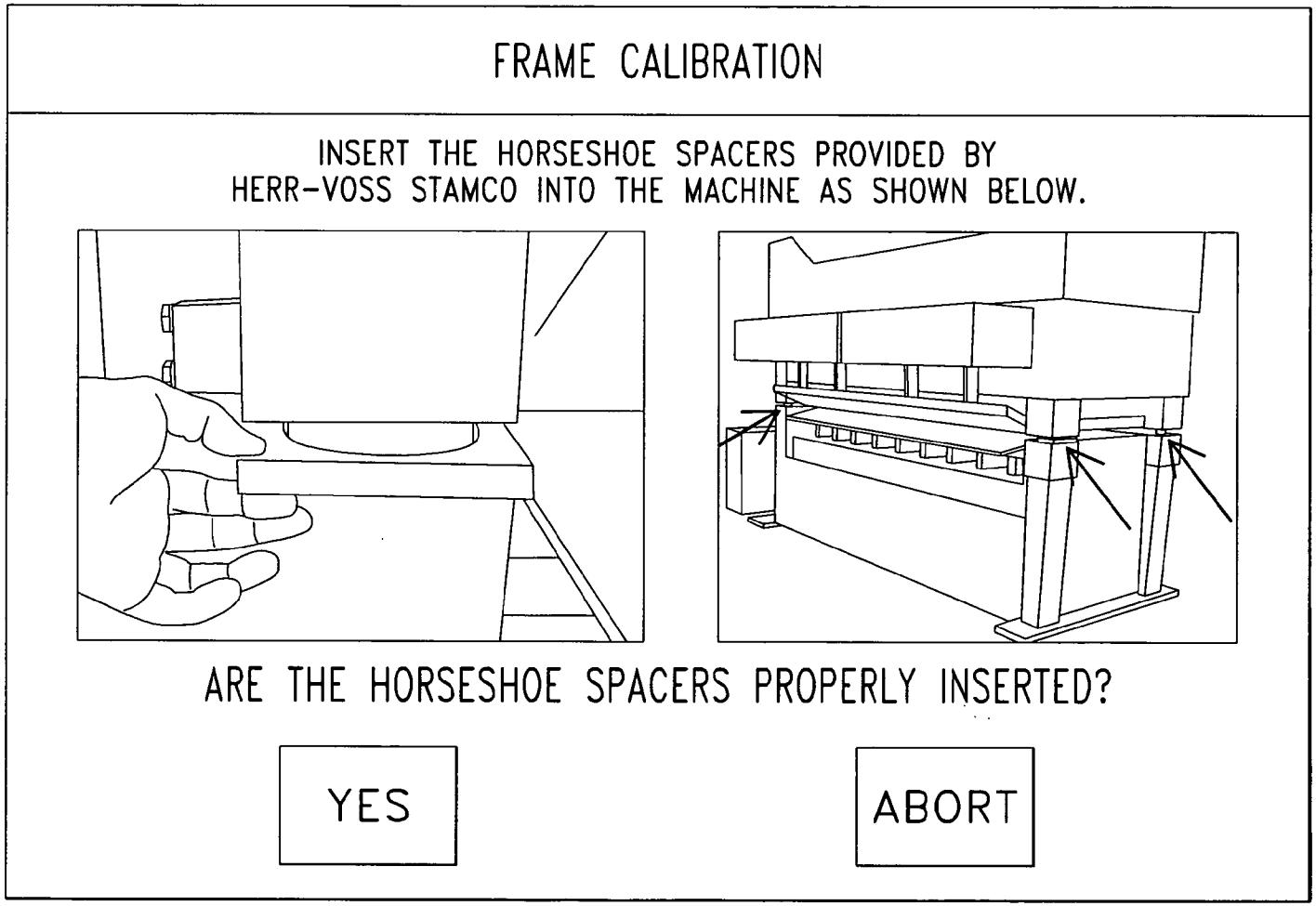

If the operator selects the frame calibration 508 option, the operator is directed to insert horseshoe spacers at the positions of the leveler 202 shown in FIG. 25. The top frame 204 is moved into position on top of the spacers. During this calibration process, the top frame 204 is moved down toward the bottom frame 208 to the point of initial contact with the spacers. This point of initial contact with the calibration bar may then be detected or determined once the top frame 204 has reached the preset calibration limit established for the calibration process (see, e.g., the limits illustrated in FIG. 10). The operator is then asked to confirm that the spacers are tightly in place as shown in FIG. 26. The top frame 204 is then opened and the operator is instructed to remove the spacers. The purpose of this calibration is to confirm that the top frame 204 is sufficiently parallel with the bottom frame 208. Typically, this calibration process is performed upon initial purchase and set-up of the leveler 202 at the work site.

Those skilled in the art will appreciate the many benefits offered by levelers configured in accordance with embodiments of the present invention. Embodiments of the invention provide precision computer numerical control (CNC) positioning; anti-backlash ball screw assemblies and actuators that minimize play; automatic and repeatable calibration of the top frame; and, menu-driven and operator friendly screen displays for operating the leveler. In addition, leveler embodiments of the present invention allow for reliance on the accuracy of roll position indicators which can result in productivity enhancements and run time cost savings. Also, with regard to safety and performance considerations, the leveler can monitor and compensate for machine stretch that can result in over-tilt or misadjustment conditions while processing material.

As used herein, a "computer" or "computer system" may be, for example and without limitation, either alone or in combination, a personal computer (PC), server-based computer, main frame, server, microcomputer, minicomputer, laptop, personal data assistant (PDA), cellular phone, pager, processor, including wireless and/or wireline varieties thereof, and/or any other computerized device capable of configuration for receiving, storing and/or processing data for standalone application and/or over a networked medium or media.

Computers and computer systems described herein may include operatively associated computer-readable media such as memory for storing software applications used in obtaining, processing, storing and/or communicating data. It can be appreciated that such memory can be internal, external, remote or local with respect to its operatively associated computer or computer system. Memory may also include any means for storing software or other instructions including, for example and without limitation, a hard disk, an optical disk, floppy disk, DVD, compact disc, memory stick, ROM (read only memory), RAM (random access memory), PROM (programmable ROM), EEPROM (extended erasable PROM), and/or other like computer-readable media.

In general, computer-readable media may include any medium capable of being a carrier for an electronic signal representative of data stored, communicated or processed in accordance with embodiments of the present invention. Where applicable, method steps described herein may be embodied or executed as instructions stored on a computer-readable medium or media.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

The examples presented herein are intended to illustrate potential and specific implementations of the present invention. It can be appreciated that the examples are intended primarily for purposes of illustration of the invention for those skilled in the art. The diagrams depicted herein are provided by way of example. There may be variations to these diagrams or the operations described herein without departing from the spirit of the invention. For instance, in certain cases, method steps or operations may be performed in differing order, or operations may be added, deleted or modified.

Furthermore, whereas particular embodiments of the invention have been described herein for the purpose of illustrating the invention and not for the purpose of limiting the same, it will be appreciated by those of ordinary skill in the art that numerous variations of the details, materials and arrangement of elements, steps, structures, and/or parts may be made within the principle and scope of the invention without departing from the invention as described in the following claims.

What is claimed is:

1. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, the control computer system being configured for:

collecting data from the motor encoder, using data collected from the motor encoder in association with moving the top frame to a zero point, comparing position data associated with the zero point to position data associated with the position transmitter, and calculating a machine stretch value based on comparing the zero point position data to the position transmitter position data.

2. The leveler of claim 1, further comprising the control computer system being configured to compensate for the calculated machine stretch value.

3. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame;

the bottom frame having a yoke for supporting at least a portion of the second set of rolls; and a motor operatively associated with the yoke for driving a tilt action of the yoke.

4. The leveler of claim 3, further comprising at least one ball screw assembly operatively associated with the yoke motor, the yoke motor including at least one encoder configured for monitoring and communicating data associated with rotations of the yoke ball screw assembly.

5. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, the control computer system being configured to measure machine stretch by comparing data received from the motor encoder to data received from the position transmitter.

6. The leveler of claim 5, further comprising the control computer system being configured to deactivate the leveler when a threshold machine stretch value is met or exceeded.

7. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, the control computer system being configured to calculate over-tilt between an entry point and an exit point of the leveler.

8. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for .driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, wherein the control computer system further comprises at least one user interface configured for permitting an operator to access at least one of an exit adjustment function to adjust exit settings for the position of one or more work rolls at an exit point of the leveler, a display of a current actual position of the work rolls at the exit point, an entry adjustment function to adjust entry settings for the position of one or more work rolls at an entry point of the leveler, a display of a current actual position of the work rolls at the entry point, a leveler speed function to adjust the rate at which material is fed through the leveler, or a leveler drive indicator that displays an amperage level for a main drive system of the leveler.

9. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, the control computer system being configured to automatically shut down the leveler once a predetermined threshold current limit is met or exceeded in connection with the top frame making initial contact with a gauge bar, calibration bar, or spacer.

10. A leveler comprising:

a top frame having at least a first set of rolls mounted thereon, the top frame including a plurality of ball screw assemblies operatively associated with the top frame to enable movement of the top frame with respect to a bottom frame having at least a second set of rolls mounted thereon, wherein the ball screw assemblies permit the top frame to move substantially vertically up or down with respect to the bottom frame;

at least one bushing installed within the leveler to limit movement of the ball screw assemblies to a substantially vertical up/down orientation;

at least one motor operatively associated with the plurality of ball screw assemblies, the motor being configured for driving action of the ball screw assemblies to move the top frame, the motor having at least one encoder configured for monitoring or communicating data associated with rotations of the ball screw assemblies;

at least one position transmitter configured for monitoring a position of at least a portion of the top frame relative to a position of at least a portion of the bottom frame; and a control computer system operatively associated with the leveler, the control computer system being configured for engaging a stretch compensation mode, wherein the stretch compensation mode includes a feedback loop that adjusts at least one setting of the leveler to account for calculated machine stretch.

* * * * *